US010833454B2

(12) United States Patent
Zhao et al.

(10) Patent No.: US 10,833,454 B2
(45) Date of Patent: Nov. 10, 2020

(54) ELECTRICAL CONNECTOR SHIELDING SHELL HAVING SIDE WALLS INTERCONNECTED TO PREVENT REAR SOLDERING LEGS THEREOF FROM SPLAYING

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Jun Zhao, Huaian (CN); Cai-Yun Zhang, Huaian (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/532,454

(22) Filed: Aug. 5, 2019

(65) Prior Publication Data

US 2020/0052444 A1 Feb. 13, 2020

(30) Foreign Application Priority Data

Aug. 7, 2018 (CN) ..... 2018 1 0891564

(51) Int. Cl.
*H01R 13/6582* (2011.01)
*H01R 12/72* (2011.01)
(Continued)

(52) U.S. Cl.
CPC ..... *H01R 13/6582* (2013.01); *H01R 12/724* (2013.01); *H01R 13/405* (2013.01);
(Continued)

(58) Field of Classification Search
CPC ..... H01R 13/6594; H01R 13/6595; H01R 13/6582; H01R 13/405; H01R 12/724;
(Continued)

(56) References Cited

U.S. PATENT DOCUMENTS 6,398,587 B1 * 6/2002 Chen ..... H01R 12/7023 439/607.35
8,882,515 B2 * 11/2014 Lv ..... H01R 13/6581 439/79
(Continued)

FOREIGN PATENT DOCUMENTS

CN 105449433 B 3/2018
TW M497866 U 3/2015

*Primary Examiner* — Gary F Paumen
(74) *Attorney, Agent, or Firm* — Wei Te Chung; Ming Chieh Chang

(57) ABSTRACT

An electrical connector includes: a housing; an upper and lower rows of contacts arranged in the housing; a primary shielding shell enclosing the housing; and a secondary shielding shell affixed to the primary shielding shell, the secondary shielding shell including a pair of side walls and a top wall interconnected between the pair of side walls, each of the pair of side walls having a soldering leg; wherein the secondary shielding shell has a rear wall integral with a respective rear edge of a corresponding side wall.

12 Claims, 4 Drawing Sheets

(51) Int. Cl.

| | |
|---|---|
| ***H01R 13/405*** | (2006.01) |
| ***H01R 13/6594*** | (2011.01) |
| ***H01R 43/02*** | (2006.01) |
| ***H01R 24/60*** | (2011.01) |
| ***H01R 107/00*** | (2006.01) |

(52) U.S. Cl.
CPC ..... *H01R 13/6594* (2013.01); *H01R 24/60* (2013.01); *H01R 43/0256* (2013.01); *H01R 2107/00* (2013.01)

(58) Field of Classification Search
CPC . H01R 43/0256; H01R 24/60; H01R 2107/00
USPC ..... 439/607.35, 607.4
See application file for complete search history.

(56) References Cited

U.S. PATENT DOCUMENTS

| | | | | |
|---|---|---|---|---|
| 9,484,679 | B2 * | 11/2016 | Guo | H01R 13/6585 |
| 9,490,595 | B2 * | 11/2016 | Little | H01R 13/6594 |
| 9,614,333 | B2 | 4/2017 | Tsai et al. | |
| 10,063,024 | B2 * | 8/2018 | Yao | H01R 13/405 |
| 2012/0231661 | A1 * | 9/2012 | Song | H01R 12/707 439/607.4 |
| 2014/0073184 | A1 * | 3/2014 | Zhao | H01R 13/6594 439/607.55 |
| 2015/0263458 | A1 * | 9/2015 | Guo | H01R 12/724 439/607.4 |
| 2016/0344142 | A1 * | 11/2016 | Zhao | H01R 13/6594 |
| 2016/0352041 | A1 | 12/2016 | Yao et al. | |
| 2017/0040748 | A1 * | 2/2017 | Tsai | H01R 12/57 |
| 2017/0047689 | A1 * | 2/2017 | Yao | H01R 13/652 |
| 2017/0288333 | A1 * | 10/2017 | Yao | H01R 13/504 |
| 2017/0302037 | A1 * | 10/2017 | Yao | H01R 13/6595 |
| 2017/0331235 | A1 | 11/2017 | Yokoyama et al. | |
| 2017/0365955 | A1 | 12/2017 | Li et al. | |
| 2018/0145455 | A1 * | 5/2018 | Ju | H01R 13/501 |
| 2018/0198246 | A1 * | 7/2018 | Cheng | H01R 12/727 |

* cited by examiner

ELECTRICAL CONNECTOR SHIELDING SHELL HAVING SIDE WALLS INTERCONNECTED TO PREVENT REAR SOLDERING LEGS THEREOF FROM SPLAYING

BACKGROUND OF THE INVENTION

1. Field of the Invention

The present invention relates to an electrical connector including a shielding shell having a pair of side walls, wherein each side wall has a rear soldering leg and a top wall and a rear wall both connected between the pair of side walls to prevent the soldering legs from splaying.

2. Description of Related Arts

U.S. Patent Application Publication No. 2016/0352041 discloses an electrical connector including, among others, a primary shell and a secondary shell affixed to the primary shell. The secondary shell includes a pair of side walls each having a rear soldering leg. The secondary shell further includes a rear baffling section having a rear wall bent downwardly. The rear wall has a pair of resisting arms each resisting against a corresponding soldering leg for restricting an outward movement thereof.

SUMMARY OF THE INVENTION

An electrical connector comprises: a housing; an upper and lower rows of contacts arranged in the housing; a primary shielding shell enclosing the housing; and a secondary shielding shell affixed to the primary shielding shell, the secondary shielding shell including a pair of side walls and a top wall interconnected between the pair of side walls, each of the pair of side walls having a soldering leg; wherein the secondary shielding shell has a rear wall integral with a respective rear edge of a corresponding side wall.

DETAILED DESCRIPTION OF THE PREFERRED EMBODIMENTS

Figure 1:
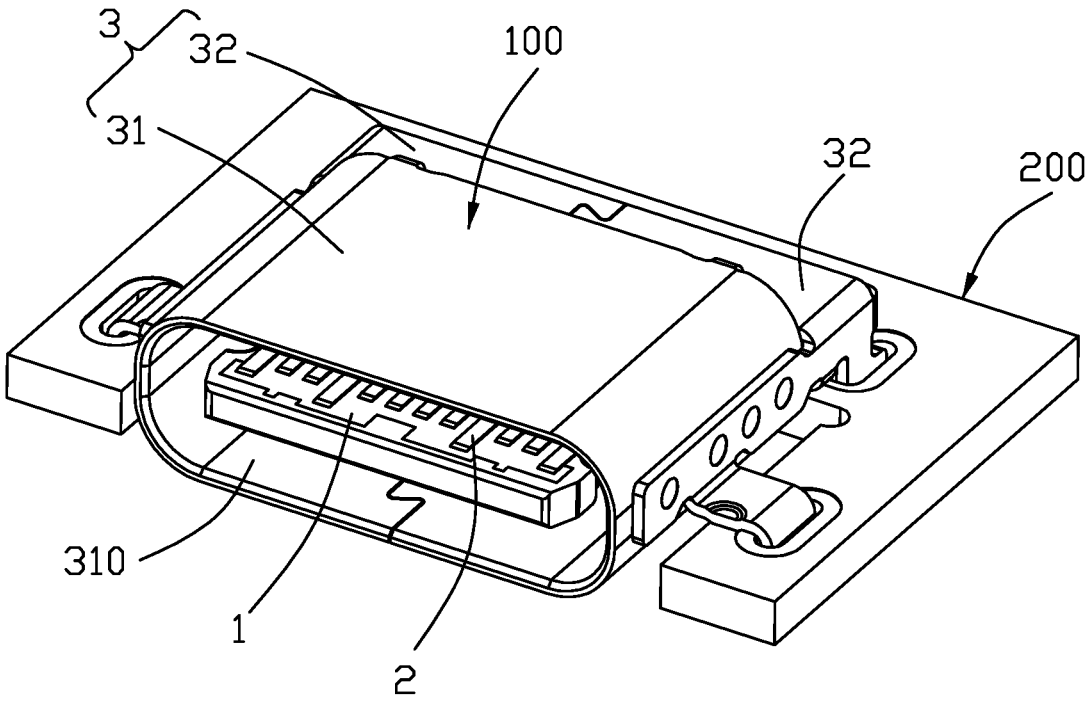
FIG. 1 is a front perspective view of an electrical connector in accordance with the present invention.
Figure 2:
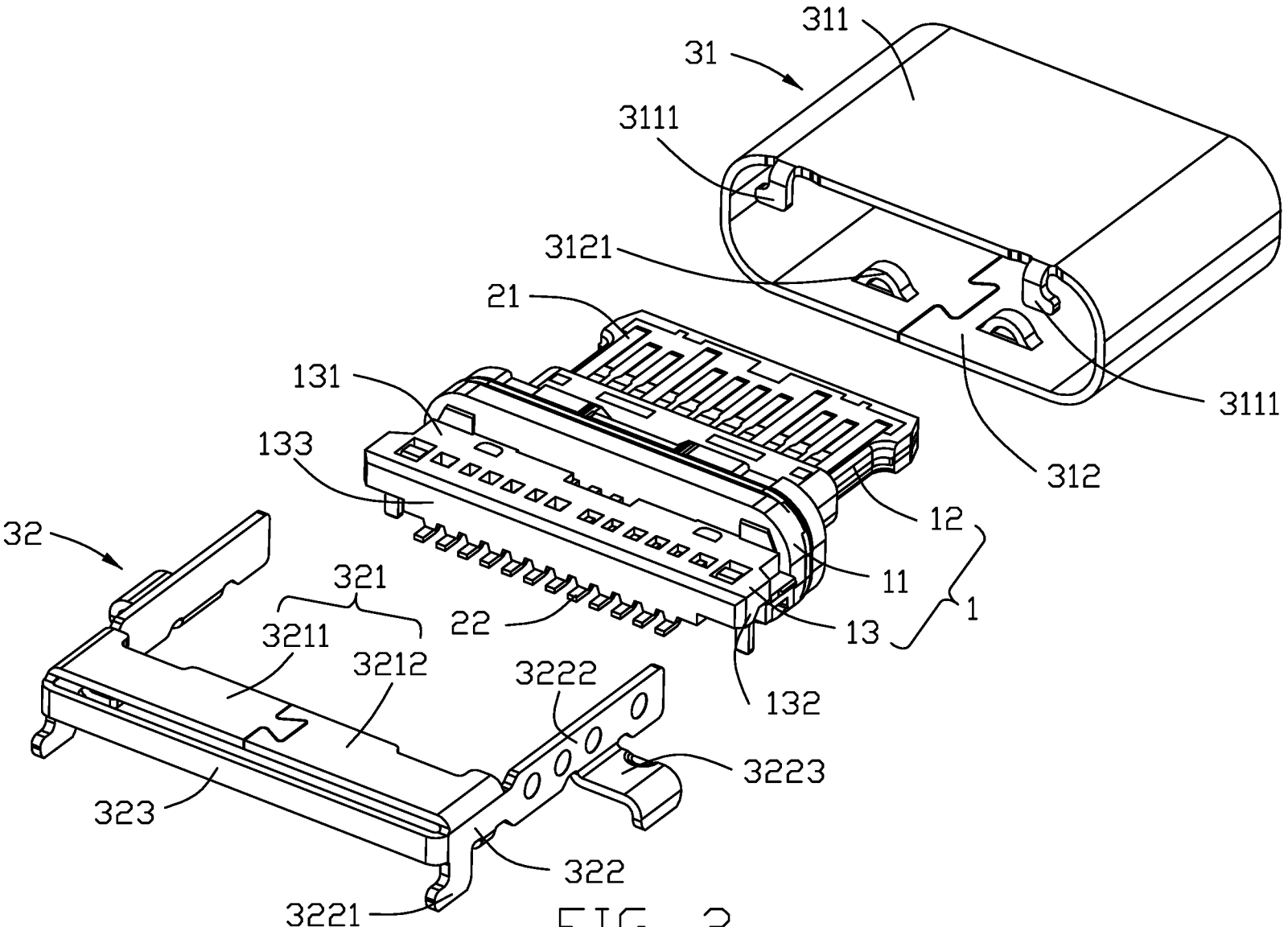
FIG. 2 is a rear exploded view of the electrical connector.
Figure 3:
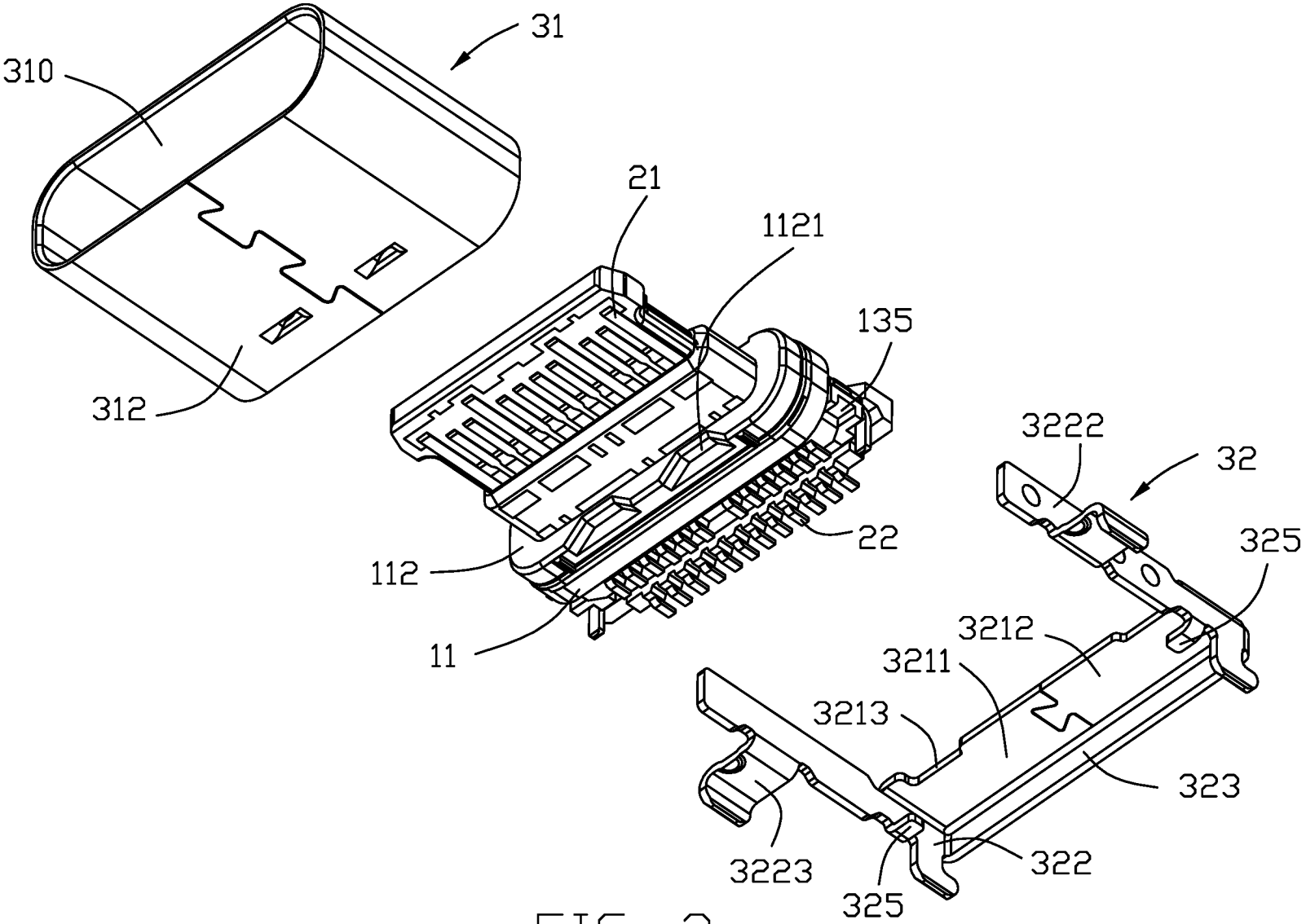
FIG. 3 is a view similar to FIG. 2 but from a different perspective.
Figure 4:
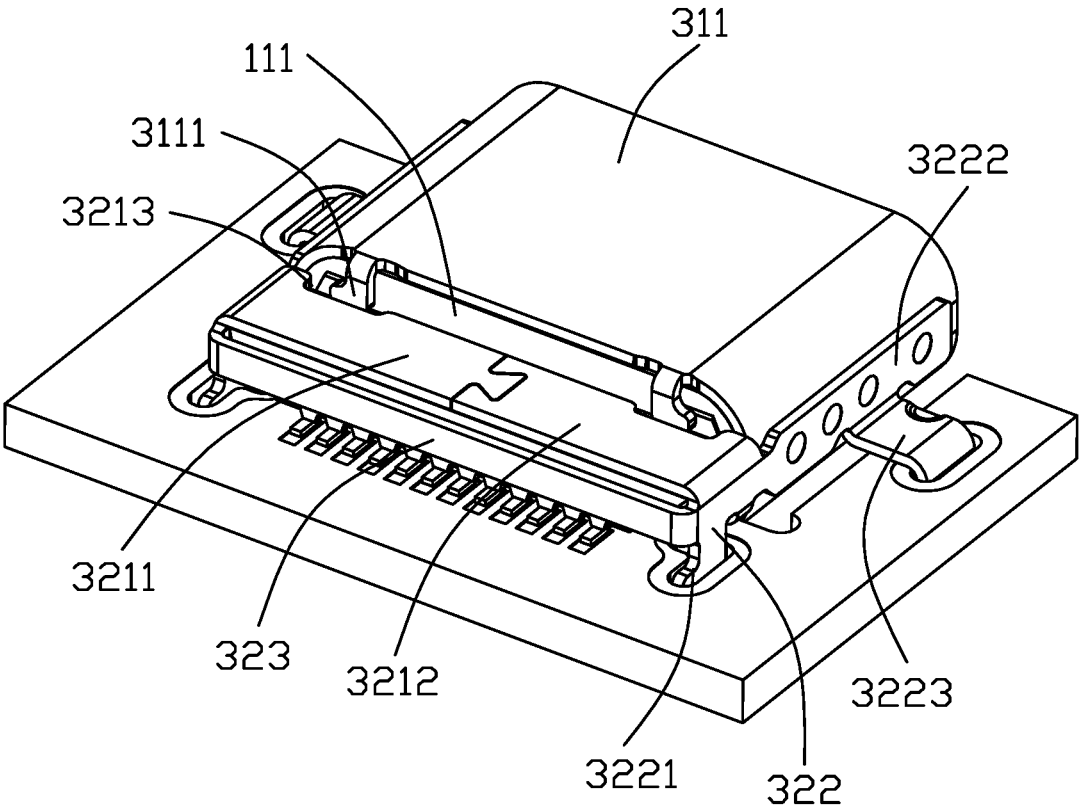
FIG. 4 is a rear perspective view of the electrical connector.

Referring to FIGS. 1-4, an electrical connector 100 to be mounted to a printed circuit board (PCB) 200 comprises an insulative housing 1, a plurality of contacts 2 arranged in the housing 1, and a shielding 3 enclosing the housing 1. The shielding 3 includes a primary shielding shell 31 and a secondary shielding shell 32 affixed to the primary shielding shell 31.

The housing 1 includes a base 11, a front tongue 12, and a rear mount 13. Each of the plurality of contacts 2 includes a contacting portion 21 exposed to the tongue 12, a soldering portion 22 extending rearward out of the rear mount 13, and an intermediate portion secured to the base 11. The primary shielding shell 31 formed from sheet metal, is metallic and fixed to the base 11 to form a receiving space or mating cavity 310 with a capsular cross-section along the front-to-back direction for insertion of a mating connector. The secondary shielding shell 32 includes a pair of side walls 322 on two side faces 132 of the rear mount 13, a top wall 321 interconnected between the pair of side walls 322 and extending over a top face 131 of the rear mount 13, and a rear wall 323 integral with a respective rear edge of each of the pair of side walls 322 and located behind a rear face 133 of the rear mount 13. Each of the pair of side walls 322 has a soldering leg 3221 for soldering to the PCB 200. The secondary shielding shell 32 is formed and bent from a metal sheet. The top wall 321 includes a first horizontal half 3211 and a second horizontal half 3212 connected/riveted to each other through a dove-tailed structure and each half 3211 or 3212 is integral with a respective upper edge of a corresponding side wall 322. Both the rear wall 323 and the top wall 321 prevent splaying of the soldering legs 3221, thereby improving effectiveness and accuracy of subsequent soldering operation of the soldering legs 3221.

Each of the pair of side walls 322 has a front extension 3222 welded to the primary shielding shell 31. Each front extension 3222 has a soldering leg 3223 bent outwardly and downwardly to reinforce soldering of the connector 100 on the PCB 200. The primary shielding shell 31 includes a top wall 311 having a pair of stops 3111 for engaging a rear face 111 of the base 11, and a bottom wall 312 having a pair of protrusions 3121 for engaging a pair of recesses 1121 on a front face 112 of the base 11, thereby presenting a front-to-back movement of the housing 1 relative to the shielding 3. To prevent the pair of stops 3111 from disengaging, the top wall 321 has a pair of notches 3213 on a front edge thereof for accommodating and restricting a movement of the stops 3111. The secondary shielding shell 32 further includes a pair of securing tabs 325 retained in the corresponding recesses 135 of the rear mount 13 so as to secure the secondary shielding shell 32 upon the housing 1. The feature of the invention is to on one hand have all the two side walls 322 and the rear wall 323 unitarily formed with a complete U-shaped structure in a top view by stamping and forming, so as to prevent the rear wall 322 deformed between the two side walls 322. On the other hand, the two side walls 322 are at least either welded to the primary shielding shell 31 or equipped with the corresponding two halves riveted to each other to commonly form a top wall. Both two fixation ways may prevent outwardly movement of the pair of side walls 322 away from each other in the transverse direction perpendicular to the front-to-back direction so as to maintain such a U-shapes structure without deformation.

What is claimed is:

1. An electrical connector comprising:

a housing;

an upper and lower rows of contacts arranged in the housing;

a primary shielding shell enclosing the housing; and a secondary shielding shell affixed to the primary shielding shell, the secondary shielding shell including a pair of side walls and a top wall interconnected between the pair of side walls, each of the pair of side walls having a soldering leg; wherein the secondary shielding shell has a rear wall integral with a respective rear edge of a corresponding side wall;

the top wall includes first and second halves connected to each other; and the first and second halves are connected through a dove-tailed structure and each integral with a respective upper edge of a corresponding side wall.

2. The electrical connector as claimed in claim 1, wherein each of the pair of side walls has a front extension welded to the primary shielding shell.

3. The electrical connector as claimed in claim 2, wherein each front extension has a soldering leg.

4. The electrical connector as claimed in claim 1, wherein:

the housing includes a base, a front tongue, and a rear mount, and the upper and lower rows of contacts are exposed respectively to two opposite surfaces of the tongue;

the primary shielding shell is fixed to the base of the housing; and the top wall of the secondary shielding shell extends over a top face of the rear mount, and the rear wall of the secondary shielding shell is located behind a rear face of the rear mount.

5. An electrical connector comprising:

an insulative housing;

an upper and lower rows of contacts retained in the housing;

a primary shielding shell formed from sheet metal and secured to the housing and forming a mating cavity with a capsular cross-sectional along a front-to-back direction; and a secondary shielding shell formed from another sheet metal and secured to the housing and including a pair of side walls and a rear wall unitarily forming together a complete U-shaped structure in a top view; wherein said pair of side walls are either welded to the primary shielding shell or respectively equipped with two horizontal halves extending toward and secured with each other to commonly form a top wall so as to prevent said pair of side walls from moving away from each other in a transverse direction perpendicular to said front-to-back direction;

each of said side walls has a rear soldering leg;

the housing includes a base, a front tongue extending forwardly from the base and enclosed in the mating cavity, and a rear mount extending rearward from the base; and the two horizontal halves are secured together via a dove-tailed structure.

6. The electrical connector as claimed in claim 5, wherein the pair of side walls include corresponding front extensions welded to the primary shielding shell by two sides of the mating cavity in the transverse direction.

7. The electrical connector as claimed in claim 5, wherein the top wall is located upon the rear mount in a vertical direction perpendicular to both the front-to-back direction and the transverse direction.

8. The electrical connector as claimed in claim 5, wherein both said side walls are respectively equipped with soldering legs for mounting to a printed circuit board while the rear wall is not equipped with the solder leg for mounting.

9. The electrical connector as claimed in claim 5, wherein the primary shielding shell includes another dove-tailed structure on a bottom side.

10. The electrical connector as claimed in claim 5, wherein each of said side walls has a front soldering leg extending outwardly in the transverse direction, and the rear soldering leg extends rearward in the front-to-back direction.

11. The electrical connector as claimed in claim 5, wherein the primary shielding shell includes a pair of stops forwardly abutting against a back side of the base in the front-to-back direction, and the horizontal halves form corresponding notches to accommodate the stops therein.

12. An electrical connector comprising:

an insulative housing;

an upper and lower rows of contacts retained in the housing;

a primary shielding shell formed from sheet metal and secured to the housing and forming a mating cavity with a capsular cross-sectional along a front-to-back direction; and a secondary shielding shell formed from another sheet metal and secured to the housing and including a pair of side walls and a rear wall unitarily forming together a complete U-shaped structure in a top view; wherein said pair of side walls are either welded to the primary shielding shell or respectively equipped with two horizontal halves extending toward and riveted with each other to commonly form a top wall so as to prevent said pair of side walls from moving away from each other in a transverse direction perpendicular to said front-to-back direction;

the housing includes a base, a front tongue extending forwardly from the base and enclosed in the mating cavity, and a rear mount extending rearward from the base; and the primary shielding shell includes a pair of stops forwardly abutting against a back side of the base in the front-to-back direction, and the horizontal halves form corresponding notches to accommodate the stops therein.

* * * * *